United States Patent [19]

Okabe

[11] Patent Number: 4,877,379

[45] Date of Patent: Oct. 31, 1989

[54] ROTARY MECHANISM FOR THREE-DIMENSIONAL VOLUMETRIC CHANGE

[76] Inventor: Kunio Okabe, 8-31, Kyomei 1-chome, Chikusa-ku, Nagoya, Aichi, Japan

[21] Appl. No.: 66,243

[22] Filed: Jun. 25, 1987

[30] Foreign Application Priority Data

Jun. 25, 1986 [JP] Japan ..... 61-147083

[51] Int. Cl.[4] ..... F01C 3/00; F01C 17/02; F01C 19/08

[52] U.S. Cl. ..... 418/51; 418/53

[58] Field of Search ..... 418/49–53; 123/241

[56] References Cited

U.S. PATENT DOCUMENTS

| | | | |
|---|---|---|---|
| 3,464,361 | 9/1969 | Voser | 418/49 |
| 3,492,974 | 2/1970 | Kreimeyer | 418/53 |
| 3,895,610 | 7/1975 | Wahl | 418/49 |
| 4,029,444 | 6/1977 | Clarke | 418/51 |

FOREIGN PATENT DOCUMENTS

| | | | |
|---|---|---|---|
| 1551082 | 5/1970 | Fed. Rep. of Germany | 418/53 |
| 47-16569 | 5/1972 | Japan | 418/49 |

OTHER PUBLICATIONS

Bensinger, W.-D., "Rotationskolben-Verbrennungsmortoren", Springer-Verlag, (1973), (Japanese translation).

Ansdale, R. F., "The Wankel RC Engine", Butterworth & Co., Limited., London, (1968), (Japanese translation).

*Primary Examiner*—John J. Vrablik

*Attorney, Agent, or Firm*—Wegner & Bretschneider

[57] ABSTRACT

A rotary mechanism for a three-dimensional volumetric change including a rotor having a partially spherical surface as a bottom surface and a substantially conical surface which includes a plurality of apexes extending substantially radially, and a member having a curved surface constituted by a surface defined by a locus of the apex due to precessing motion of the rotor. A space defined in a spherical space and having its volume changed by relative precessing motion between the member and the rotor serves as a working space. The rotor is substantially spherical cone with apexes and the curved surface of the member is a spherical peritrochoidal surface. The rotor conical surface is optimumly an inner envelop of the spherical peritrochoidal surface produced by the relative precession. The rotary mechanism may be expansion and/or compression machine; pump, blower or internal combustion engine, or generally, energy conversion machine.

93 Claims, 16 Drawing Sheets

$\omega : \omega' = 3 : 2$ $\omega : \omega' = 3 : 2$ $\omega : \omega' = 2 : 3$ $\omega : \omega' = 2 : 3$

ROTARY MECHANISM FOR THREE-DIMENSIONAL VOLUMETRIC CHANGE

BACKGROUND OF THE INVENTION

This invention relates to a rotary mechanism and, more particularly, to a rotary mechanism for producing a three-dimensional volumetric charge.

A variety of rotary mechanisms are known in the art, a typical example of which is that employed in the Wankel rotary engine. The rotary mechanism in a Wankel rotary engine includes a cocoon-shaped casing the inner peripheral surface of which defines a two-node peritrochoidal curve, and a substantially triangular rotor, the external form whereof defines an inner envelope of the peritrochoidal curve, adapted to rotate eccentrically within the rotor casing, thereby utilizing a volumetric change produced in a working chamber at such time. The working chamber is formed by giving thickness to an in-plane gap (area) formed by the housing and rotor. Almost all of the rotary mechanisms in practical use are based on the same principle.

More specifically, the volumetric change in the conventional rotary mechanism is based on a change in a two-dimensional plane, and the lateral faces of the rotor merely ensure the volume of the space and form a space seal without participating in the volumetric change. In this sense, therefore, the volumetric change is essentially two-dimensional. Accordingly, there is an inherent limitation upon engines utilizing a two-dimensional volumetric change.

SUMMARY OF THE DISCLOSURE

A primary object of the present invention is to provide a novel rotary mechanism based on a three-dimensional volumetric change.

A particular object of the present invention is to provide a novel rotary mechanism which is not subjected to a two-dimensional constraint, and in which three-dimensional volumetric change can be achieved, while effectively exploiting the various advantages generally possessed by the rotary mechanism.

Further object will become apparent in the entire disclosure.

According to the present invention, the foregoing object is attained by providing a rotary mechanism, particularly a spherical precessing rotary mechanism, which performs a three-dimensional volumetric change.

Specifically, the invention provides a rotary mechanism for a three-dimensional volumetric change comprising a rotor having a partially spherical surface as a bottom surface and a substantially conical (or substantially pyramidal) surface which includes a plurality of apexes (or edges) extending substantially radially, and a member having a curved surface constituted by a surface defined by a locus of the apexes due to precession of the rotor relative to the member, wherein a space(s) defined in a spherical space of a casing and having its volume changed by relative precession between the member and the rotor serves as a working space(s).

The principle of the invention will now be described in detail.

The rotor of the present invention typically comprises a substantially conical (or substantially pyramidal) body the bottom surface of which is a part of a spherical surface, with the center of the sphere being the vertex of the cone (or pyramid). [Though the conical surface generally is positive (convex), it is also permissible for the conical surface to be negative (concave).] Typically, the rotor precesses steadily within the spherical space of a casing in the manner of a spherical top, whereupon one point on the conical portion of the rotor moves along a wave-like curve inside the spherical surface. By providing a radially extending apexes on the conical portion, the curved surface defined by the locus of the apexes can constitute the curved surface of the casing member corresponding to the conical portion of the rotor. A working space is formed between the curved surface of the casing member and the surface of the conical portion of the rotor (particularly, the pyramidal surface area between the two neighbouring apexes), and an effective three-dimensional volumetric change is produced by precession of the rotor. In the precessing motion, the rotor spins about the axis of the rotor itself, during which time the rotor axis itself performs planetary rotation (i.e., rounds) about a principal axis which intersects the spin axis at an angle.

The rotation of the rotor is transmitted to the principal shaft (transmission shaft) via a transmission mechanism. The principal shaft forms an output shaft or input shaft. The principal shaft and rotor spin shaft define a fixed angle. The rotor spins and the rotor spin axis per se performs planetary rotation about the principal shaft. In other words, precession is produced. At such time the locus or orbit of a point A on the rotor apex is produced on a single spherical surface. When a predetermined relationship exists between the planetary rotational velocity of the rotor spin shaft and the spin velocity of the rotor, the locus of the point A on the apex closes to define a spherical peritrochoidal curve defined in a spherical coordinate system.

It is convenient to use a spherical coordinate system when discussing motion on the surface of a sphere. A trochoidal curve in a spherical coordinate system (i.e., spherical trochoidal curve) corresponds to a trochoidal curve in two-dimensional coordinate system on a plane. Primary dimension of the spherical rotary machine can be expressed more simply by using vectors.

ADVANTAGES

The present invention makes it possible to realize expansion and/or compression mechanisms which effectively vary volume three-dimensionally by using a spherical precessing rotor. The invention is useful as the rotary energy conversion system of a pump, engine, blower, compressor or the like and therefore has a high utility value. Other advantages are a reduction in space, shape simplification and pressure resistance. A piston ring-type seal can be applied against the spherical surface of the casing and the length of the seal surface (or line) can be reduced in comparison with the Wankel type rotary engine, thereby reducing sliding frictional resistance and wear. Further, number of sealing members can be reduced, i.e., one working space can be sealed by two apex seals and one spherical seal. By comparison, the Wankel rotary engine requires two apex seals and two seals on both sides for one working chamber. Besides the seals on the both sides are required over the entire surface of the working space. Note, however, for certain use as pumps or blowers the seal may be eliminated occasionally depending upon the nature of fluid or purpose.

The volume efficiency of the working space relative to a given engine space can be increased. That is, the ratio of the effective maximum volume (i.e. the stroke displacement or volume) of one working chamber to the total internal volume of the spherical casing is about 26% at R=90°, $\theta$=18°. With an ordinary Wankel type rotary engine, however, the ratio of the effective maximum volume (stroke displacement) of the working chamber is about 22% at generating ratio (trochoid ratio) K=7 with respect to the total internal volume of the casing. Since this maximum volume (ratio) is proportional to torque, the present invention exhibits an excellent spatial output efficiency per working chamber. When an embodiment with three working chambers is considered, even a higher output efficiency can be attained. It is possible to obtain a higher compression ratio (or a higher expansion ratio). By modifying various factors a still higher ratio of the stoke displacement can be achieved (FIG. 15). With respect to the Wankel machine there is a limitation that the compression ratio depends on the trochoid ratio K, which offers a discrepancy that the ratio of the stroke displacement to the overall casing volume must be decreased in order to increase the compression ratio. However, the present invention is free from such limitation.

Since the rotor motion is an entirely rotational motion, the rotation naturally is smoother than in a reciprocating engine. In addition, the precessing motion has greater stability than the eccentric rotor motion in the conventional Wankel engine.

Since the intake, compression, expansion and exhaust processes (or strokes) can be readily set, the mechanism of the invention has a wide range of application even as an internal combustion engine.

BRIEF DESCRIPTION OF THE DRAWINGS

FIGS. 4(I) through 4(IV) are diagrams illustrating the volumetric change of a working chamber in an embodiment of the invention based on the equidistant polar projection;

DESCRIPTION OF THE PREFERRED EMBODIMENT

A preferred embodiment of the invention will now be described.

In actual practice, it is preferred that a rotor support mechanism comprising a small sphere be cocentrically arranged at the cone vertex portion (the center of the sphere) of the rotor, in which case the shape of the cone vertex portion of the rotor will be a three-dimensional shape cut by the small sphere (or small spherical core), i.e., a substantially frustum of pyramid-like shape defined between two (large and small) spheres.

The relative precession between the rotor and the member forming the curved surface of the rotor apex locus typically is precession of a substantially conical rotor, as set forth above. However, the converse is also possible. Depending upon the case, precession can also be achieved by a combination of simple rotational motions of both the rotor and casing, as will be described later.

For the sake of the following description and arrangement, the invention will be described for a fundamental case where the rotor precesses and the member defined by the curved surface of the rotor apex locus is fixed as part of the casing.

Figure 1:
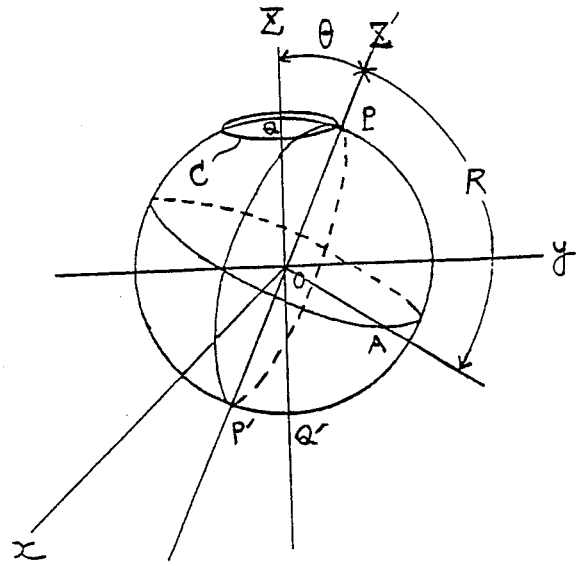
FIG. 1 is a basic diagram for describing the present invention.

In FIG. 1, let the Z axis be a transmission axis, which corresponds to a transmission shaft, and let a Z′ axis represent a spin axis. A point P represents an intersection between the spin axis of the rotor and a sphere, and point P′ represents an intersection between the spin axis and the sphere on the opposite side (that is, P′ is the antipode of P). Let $\omega$ represent the angular velocity of planetary rotation at which the spin axis rounds about the transmission axis, and let $\omega'$ represent the angular velocity of relative revolution of the rotor with respect to the motion per se of the spin axis. When the ratio of $\omega$ to $\omega'$ is $1:[1-(1/n)]$ (where n is a natural number of 2 or more and equal to the number of apexes of the rotor), the curve is closed and the locus of a paint on the sphere A, which is an intersection of the radially extending line OA with the sphere, describes a spherical peritrochoidal curve (in one typical embodiment n=3). At such time the locus described by one point on the apex of the rotor depicts a spherical peritrochoidal curve.

Figure 2:
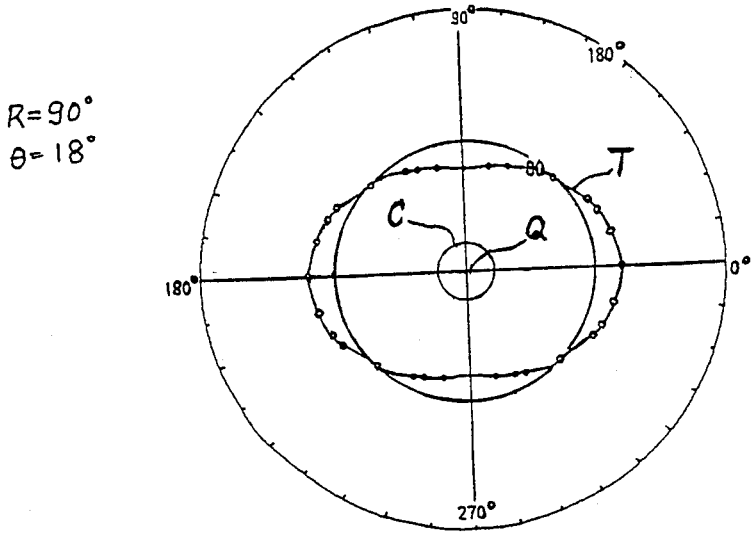
FIG. 2 is an equidistant polar projection of the spherical surface used in the present invention together with an embodiment thereof.

Though it is possible to describe a spherical trochoidal curve on a sphere, it is difficult to illustrate the curve on a plane. If one is compelled to do so, one method of illustrating the curve is to use an equidistant projection employed in geography. A pole Q is a point at which the principal axis Z appears on the sphere. In FIG. 2, cocentric circles correspond to latitude and are equidistantly spaced from the center to 180°, the 180° signifying a pole Q′ on the opposite side, while 90° corresponds to the equator. The straight lines in the radial direction correspond to longitude and divide one revolution into equiangular segments of 0° to 360° in the counter-clockwise direction.

With such an arrangement, a straight line passing through the center Q of FIG. 2 represents a great circle, and a segment of the straight line (a great circular arc) corresponds to a central angle subtended by the segment. Theoretically, this can be simplified by considering a unit sphere using the method of circular measure.

A closed curve T in FIG. 2 is obtained by describing an n=3 spherical peritrochoidal curve on a spherical surface, reading latitude and longitude from the curve described on the spherical surface, and plotting by the equidistant polar projection. A circle shown by the solid line near the central pole Q is the locus of the intersect P between the spin axis Z' and the surface of the sphere. In FIG. 1, let an angle ∠POA, which defines the distance from the point P to the apex A of the rotor, represent a generating angle R (where O is the center of the sphere). FIG. 2 illustrates a case where the generating angle R is equal to 90°, and the angle $\theta$ defined by the spin axis and principal axis is equal to 18°. In general, however, $R>2\theta$, where $\theta$ can have a value up to 60°.

Assume that a rotor has a leaning angle $\theta$, (may be referred to as an "eccentric angle"), defined by the spin axis and the principal axis, and the generating angle R. If such a rotor precesses at an angular velocity of ratio $1:[1-(1/n)]$, the end A of the rotor apex will form a spherical peritrochoidal curve. A mathematical expression of the curve on this spherical surface can be obtained in spherical coordinates by using the formula of a spherical triangle (see FIG. 3). Since the central circle C is the locus of the point P which appears on the spherical surface of the spin axis, this is a circle whose radius is the leaning angle $\theta$. The coordinates of point P after t sec are ($\theta$, $\omega$t). For a case where n=3, the coordinates (X, $\Phi$) of point A are as follows, using a parameter $\phi=\phi$ (t) (the angle defined by QP and QA):

$$\Phi=\omega t+\phi \quad (1)$$

$$\cos X=(\cos\theta\cos R)-(\sin\theta\sin R\cos\tfrac{2}{3}) \quad (2)$$

$$\sin X/\sin-\tfrac{2}{3}\omega t=\sin R/\sin\phi \quad (3)$$

where the angles $\theta$, $\omega$t, $-\frac{2}{3}\omega$t are Eulerian angles ($\theta$,R>0, direction of $\omega$ and $\omega'$ is based on Euler—i.e., counterclockwise is positive, see "Statics" by Beer and Johnston; Note $\phi$ includes also angular direction where counterclockwise is positive). Problems related to rotary engines, namely problems relating to the angular velocity, angular acceleration and swing angle of the apex, and volume of the casing (or housing) and the stoke displacement can be solved by using these equations. By replacing the spin angle $\frac{2}{3}\omega$t by $(n-1)/n\,\omega$t an equation representing the general relationship for the number "n" can be established.

Figure 3:
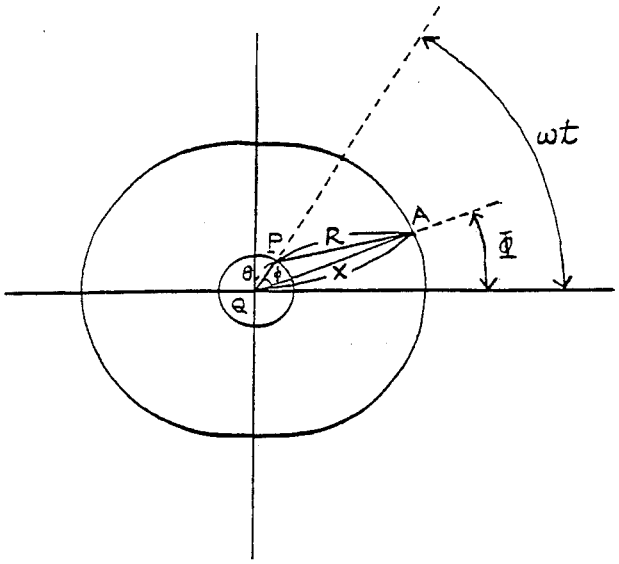
FIG. 3 is a diagram for describing a planar transformation of a spherical surface based on the equidistant polar projection.

It will be understood that a spherical peritrochoidal curve defined by FIGS. 2 and 3 and Eqs. (1) through (3) in a spherical coordinate system exhibits a certain corresponding relationship, as contrasted to the case of a well-known peritrochoidal curve on a two-dimensional plane. More specifically, a generating radius R and eccentric distance r in the case of two-dimensional trochoidal curve appear respectively as a generating angle R and an eccentric angle (intersection angle) between a basic circle C and the principal axis on the spherical surface in the case of the spherical trochoidal curve. That is, a segment of a straight line on a two-dimensional trochoidal curve corresponds to an angular component of a great circular arc in a spherical coordinate system.

In the present invention, the locus of the end A of a rotor apex defines a spherical peritrochoidal curve, but the locus of an arbitrary point A' (FIG. 7) on the apex also forms a similar curve. Therefore, the form of the curve traversed by the apex is defined as a "spherical peritrochoidal cone". In other words, by connecting the spherical peritrochoidal curve, which is the locus (generating line) of the end A of the apex, and the center of the sphere (the cone vertex or imaginary vertex point of the rotor), a curved surface (family of generator) will be formed in which the outer edge forms a single wave on the spherical surface (in a case where the apex forms a straight line (generator) extending from the point A to the center of the sphere). This wave-like curved surface is the casing curved surface (casing plate curved surface) corresponding to precession of the rotor apex. Typically, a plurality of apexes intersect each other at the cone vertex.

Preferably, the outer periphery edge of the substantially (or generally) conical curved surface of the rotor is formed of an inner envelope of a group of the above-mentioned spherical peritrochoidal curves. The locus of a radius (produced when the rotor undergoes precession) connecting one point on the internal envelope and the cone vertex (the center of the sphere) is such that the relative spacing between the locus of radius and the inner peripheral surface of the casing plate varies periodically in accordance with the precession of the rotor. As a result, a three-dimensional volumetric change occurs periodically. This can be utilized as a working space (i.e., working chamber).

Figure 4:
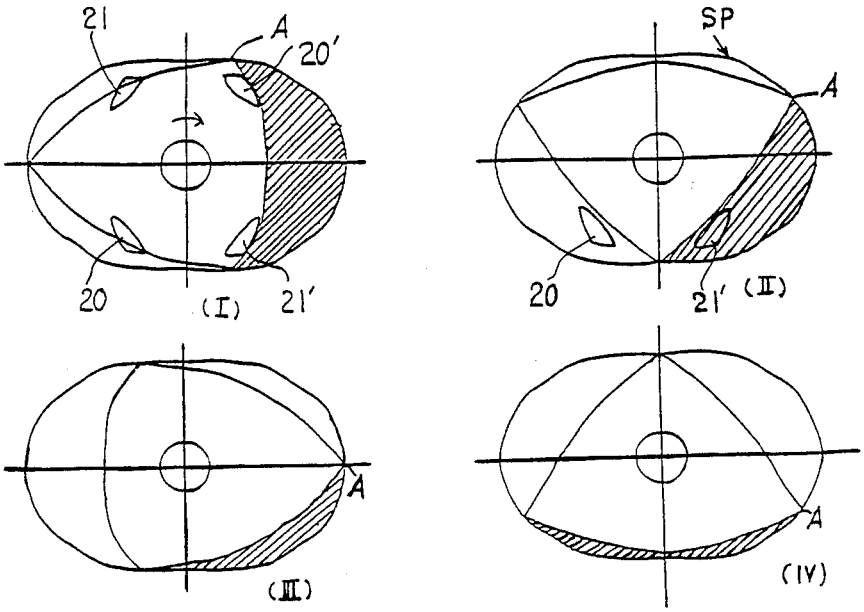

FIG. 4 illustrates the rotor, in which (I) through (IV) show the manner in which the rotor rotates. These are projections, on a two-dimensional plane, of a peritrochoidal curve defined in a spherical coordinate system. The equidistant projection method of FIG. 2 is used. In accordance with an equidistant polar projection, an expression holds similar to that obtained by expressing a two-dimensional volumetric change rotary engine in a polar coordinate system. With the equidistant method, the rotor rotates while its contour is deformed with such rotation.

As hereinabove mentioned, it is preferred that the substantially conical curved surface of the rotor defines an inner envelope surface which includes the radius of the apex. However, it is possible to adopt a curved surface in which portions exclusive of the apex recede slightly into the rotor portion from the inner envelope surface. Further, reduction of the rotor sliding surface from the theoretical curved surface is generally known to be necessary for the rotary machines having a sliding surface and is allowable also in the present invention.

The radial configuration of the apex of the rotor (the cross-sectional shape including the rotor spin axis) typically or practically is a straight line, for which it is essential to be composed of a straight line connecting the rotor spin axis (typically, the center of the sphere) and the outer end of the apex (the outer end which appears on the sphere). Though the construction is somewhat complicated, the radius (the shape of the apex) can be made a curve. In this case, however, the casing plate has a sectional configuration corresponding to the motion of the apex shape.

The rotary mechanism for three-dimensional volumetric change (or spherical precessing) according to the present invention utilizes the volumetric change of a working space (chamber) that accompanies the relative precession between the rotor and corresponding member. The mechanism is useful as an expansion or compression machine. For example, the mechanism can be utilized as an output engine (e.g. internal combustion engine, steam engine, pneumatic or fluid motor, etc.) or as a working machine (e.g. a pressurizing or suction pump, compressor, etc) or fluid/fluid energy conversion machine, generally, as an energy conversion mechanism. In such case, a fluid inlet and outlet are provided at the prescribed locations.

Embodiments of the invention will now be described.

EMBODIMENTS

An embodiment will now be described in which the invention is applied to a pump having a spherical precessing rotary mechanism.

Figure 5:
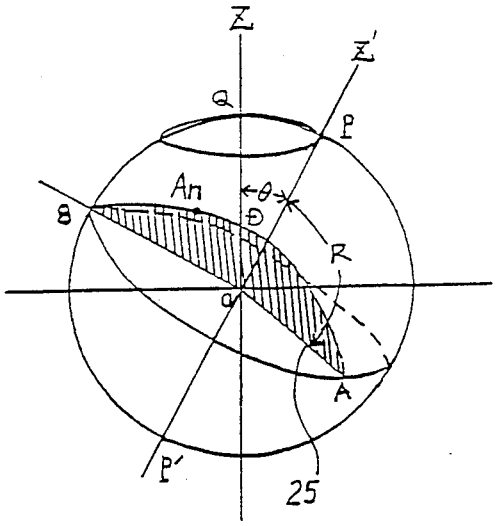
FIGS. 5 and 6 are diagrams for describing an embodiment of the invention.

In FIG. 5, $\theta$ represents an angle defined by the transmission axis Z and spin axis Z', and R represents the generating angle.

Figure 6:
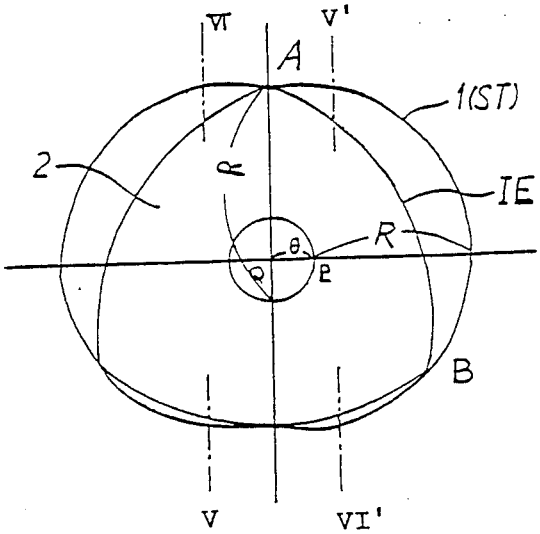

Using a unit sphere for the sake of convenience of explanation, we have $\widehat{QP}=\theta$, $\widehat{PA}=R$ for a great circular arc $\widehat{QA}$. When the rotor at an angular velocity $\omega'$ of ratio $\omega:\omega'=1:[1-(1/n)]$ rotates about the spin axis Z' and the spin axis Z' undergoes orbital rotation at an angular velocity $\omega$ about the transmission axis Z, the end A of the rotor apex describes a spherical peritrochoidal curve defined by the leaning angle $\theta$ and generating radius R on a spherical surface, and the great circular arc $\widehat{QA}$ forms a spherical peritrochoid ST (FIG. 6).

The shape of a body which can rotate in the spherical peritrochoidal curve ST is limited to within the inner envelope IE of the peritrochoid. If the gear ratio of the gears in a transmission mechanism, namely the gear ratio of an external gear to an internal gear, is 2:3, then the peritrochoid is two-lobed (cocoon shaped) and the rotor 2 is of the three-node type (spherical triangular). In FIG. 6, the rotor is formed of an inner envelope IE of a peritrochoidal curve defined by the leaning angle $\theta$ and generating angle R. FIG. 6 shows a substantially triangular rotor 2 (projection of its bottom spherical triangular) converted from a precessing rotor. A segment AB of the inner envelop IE in FIG. 6 corresponds to the spherical curve $\widehat{ADB}$ on the surface of the sphere shown in FIG. 5. If the size of the sphere is made small in FIG. 5, O and R will not vary, irrespective of the size of the sphere, since these are angles. The shape $\widehat{ADB}$, which is expressed by $\angle POAn$ (where An is a point on $\widehat{ADB}$), also does not vary irrespective of the sphere size. The shape of lateral surface of the rotor is formed by an inner envelope of a family of curves formed on the spherical surface of an imaginal rotor as the rotor rotates. In other words, the lateral face of the rotor is conical lateral face connecting the spherical curve $\widehat{ADB}$ and O, where O is the cone vertex (referred to as "spherical conical surface"). The other two faces can be produced in a similar manner.

As set forth above, the outer edge A of the apex of the rotor describes the spherical peritrochoidal curve ST in accordance with the precession of the rotor. The curve 1 shown in FIG. 6 is a peritrochoidal curve expressed by the equidistant projection.

A casing plate 3 (see FIG. 7) which delimits the working chamber in cooperation with the lateral faces of the rotor forms a surface defining the locus of the line segment OA (i.e. the rotor apex 25) in FIG. 5. Accordingly, the rotor apex 25 (the line segment OA) rotates while slidably contacting the casing plate surface 32. In other words, the shape of the casing plate surface 32 confronting the lateral faces of the rotor comprising the inner envelope curved surface is a curved surface (a spherical peritrochoidal cone surface) connecting the spherical peritrochoidal curve 31 and center O in the present embodiment. Generally, this is a curved surface forming a set of spherical peritrochoidal curves defined with respect to an arbitrary point A' on the apex in dependence upon a shape of a cross-section, which includes the rotor spin axis, of the rotor apex 25.

In accordance with the principle set forth above, there are decided a substantially conical surface of the rotor and the shape of the corresponding casing plate surface.

The inclination of the casing plate surface, namely the maximum value of the angle from the transmission axis, is $\theta+R$, and the minimum value is $R-\theta$ (FIG. 6).

Figure 24:
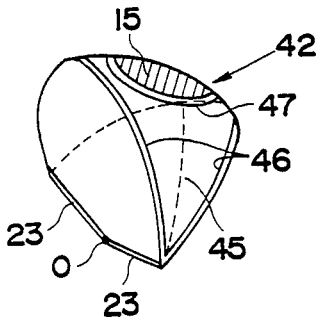

Preferably, in order to make sure of the seal (particularly, irrespective of temperature change) at the sliding portion of the apex, and in order to prevent sliding wear, a seal 23 is formed to maintain an air-tight condition at the rotor apex (line segment AO). Preferably, the seal is capable of moving up and down (i.e. of receding into the rotor), and is pressed against the casing plate surface by a seal spring at all times. In this case, the rotor apex rotates while positively contacting the casing plate surface at all times, thereby maintaining an excellent air-tight seal. Sealing between the spherical (bottom) surface of the rotor and the spherical casing inner surface can be effected similarly. FIG. 24 shows Examples of the sealing. Particular sealing members may be eliminated depending upon nature of fluid, materials of the rotor and casing, and purpose of use.

Figure 9:
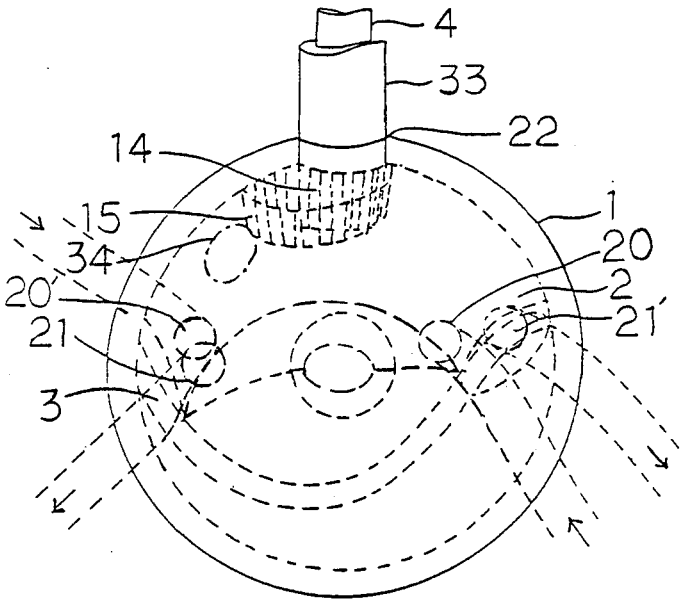
FIG. 9 is a view showing an embodiment of the invention in the assembled state.

In FIG. 9, casing 1 is a hollow sphere, in which the spherical rotor 2 and casing plate 3 are accommodated. The casing plate 3 is fixedly secured to the casing 1 at a predetermined angle and predetermined position. The upper portion of the casing is provided with a hole 22 through which a support shaft 33 is passed for rotatably supporting the transmission shaft 4. The support shaft 33 is secured to the hole 22.

Precession at a rotational velocity of a predetermined ratio can be obtained by assigning a suitable value to the gear ratio of an external gear 14 of support shaft 33 to an internal gear 15 of the rotor. In the present embodiment, a spherical peritrochoid of $n=3$ is used, and bevel gears are employed in which the gear ratio of the internal gear 15 to the external gear 14 is 3:2.

Figure 8:
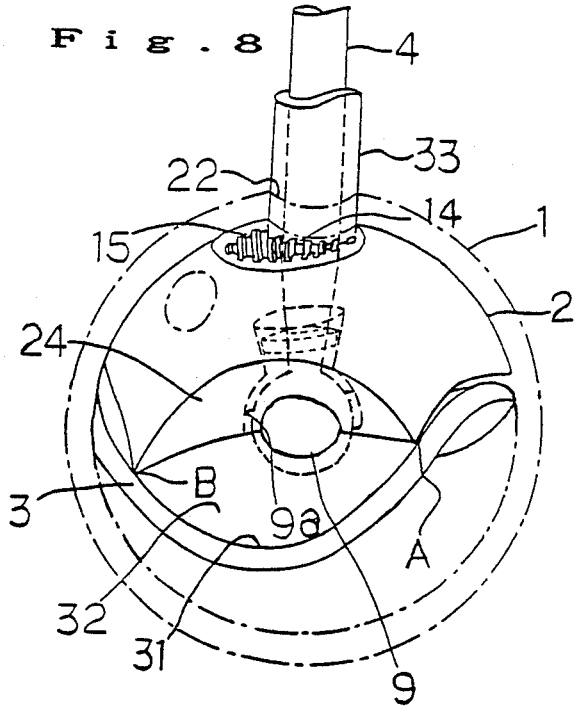

As shown in FIG. 8, a small sphere (spherical core) 9 is used to axially support the central portion of the spherical precessing rotor 2, which rotates while contacting the inner surface of the spherical casing and planetarily rounds about the support shaft 33. The imaginary vertex of the rotor cone and the center (the center is the intersection of the rotor spin axis and transmission axis) are brought into coincidence by the small sphere 9. As a result, the spherical precessing rotor 2 precesses about the support shaft 33 at a leaning angle $\theta$ at all times. The small sphere 9 can be fixed to the casing plate 3, to the rotor 2, or slidably arranged to both as an intermediary like a ball bearing.

Figure 7:
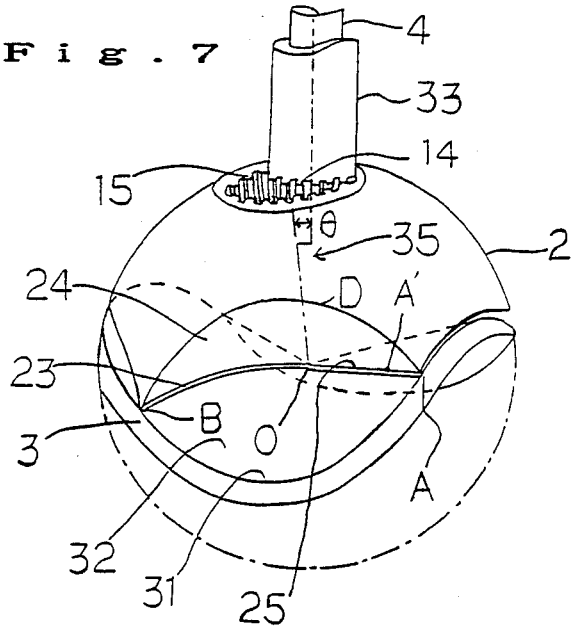
FIGS. 7 and 8 are partial elevational perspective views of embodiments of the invention, respectively.
Figure 12:
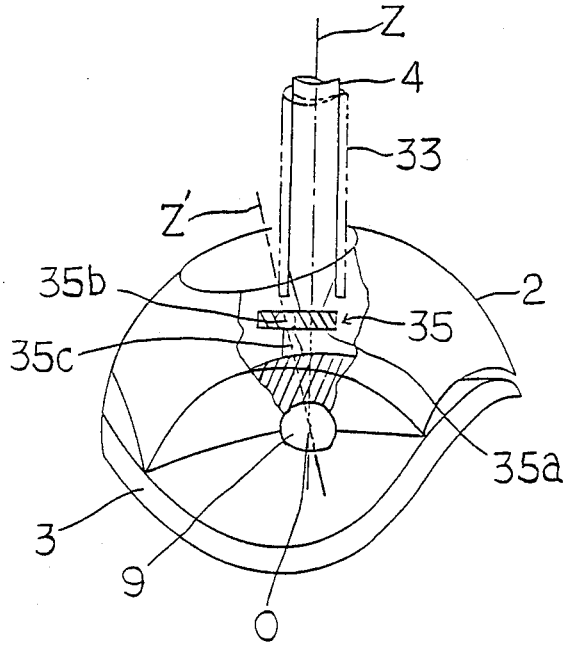
FIGS. 12, 13 are partial schematic views showing examples of a rotary transmission mechanism.

The transmission mechanism between the rotor and transmission shaft 4 is implemented by a precession journal (or angular transmission journal) 35, namely by mechanism which converts precession to ordinary axial rotation (axial rotation at a fixed position). This is necessary due to the fact that the transmission shaft 4 and rotor spin shaft Z' cross. One example is as shown in FIG. 7, in which a precession (eccentric) crank or eccentric disk (bearing) for transmitting rotational motion is arranged between the rotor spin shaft and transmission shaft 4, which forms a leaning angle $\theta$ with the spin shaft. A specific example is shown in FIG. 12, in which the end portion of the transmission shaft 4 projecting into the rotor 2 is provided with an eccentric ring 35*a*, and the central portion of the rotor is connected via a rod 35*c* (which extends along the rotor shaft from the rotor center O) equipped with a ball joint the center of which is an eccentric position 35b (see FIG. 12). The ball joint disposed at the eccentric position 35b of the eccentric ring 35a connects the eccentric ring 35a, secured to the shaft 4, to the central portion of the rotor via the rod 35c. In case of such an upward output, the transmission shaft 4 is passed through the interior of the support shaft 33 and is concentrically supported so as to be capable of rotating. The rotor 2 is supported in the casing via the spherical core 9 so as to be capable of precession.

As for a modification of the rotor transmission mechanism, the surface of the spherical core 9 shown in FIG. 8 may be provided with a spherical spline 9a (formed to extend parallel to the rotor shaft) and the transmission shaft 4 may be extended to the spherical core 9 and connected to the spherical core 9, the spline 9a engaging a corresponding spline provided on the rotor 2. The spherical core 9 is rotatable relative to the casing plate 3.

Figure 11:
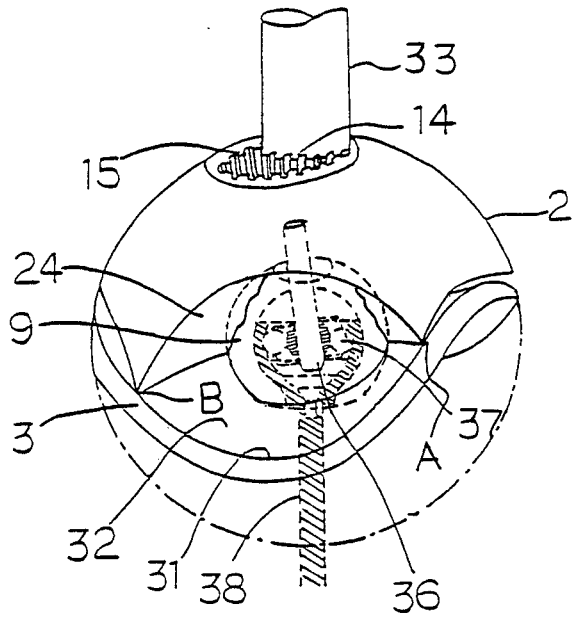
FIG. 11 is a partially sectional elevational respective view illustrating another embodiment of a transmission mechanism.

Further, the spherical core 9 is formed integral with the rotor and the interior of the spherical core 9 is provided with a precession journal (or tilt coupling) of the type which engages in the rotating direction and engages so as to be rockable through the leaning angle $\theta$. The precession journal can also provide an upward output as well as a downward output, as shown in FIG. 11. The rotor transmission mechanism of FIG. 11 is an example in which a Barfield-type shaft coupling is used inside the spherical core 9. A coupling of this type transmits rotation even if the angle at which two shafts intersect changes freely. Such a coupling enables uniform transmission without a fluctuation in rotating force. A prime mover shaft 36 is brought into agreement with the spin shaft of rotor 2 and is secured to the rotor 2. Rotation of the rotor accompanying the precession of the rotor is transmitted to a follower shaft 37 via a ball 37.

Figure 13:
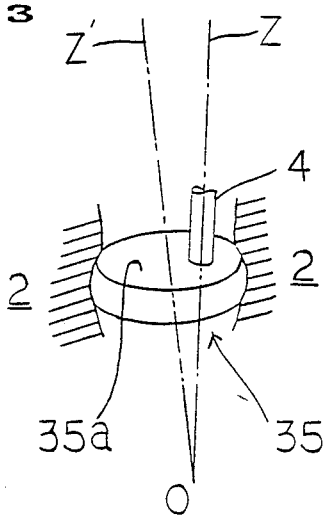

FIG. 13 illustrates another example of a precession journal. An eccentric disk 35a is arranged so as to be rotatable and tiltable with respect to the rotor 2 in the spherical, hollow interior of the rotor. The disk 35 has a tilt rotor shaft Z' as its center and an output shaft Z as its off-center (and tilt). The outer periphery of the disk is spherical and is supported with its outer periphery in slidable contact with the corresponding hollow portion of the rotor. The same function may be realized by a roller bearing unit having tiltable outer race.

Inlets 20, 20' and outlets 21, 21' of the casing corresponding to positions V, V' and VI, VI' in FIG. 6 are provided on the spherical surface of the casing disposed above the casing plate 3. The disposition and shape of the ports can be designed visually as shown in FIG. 4. Namely, the shape of the port can be designed to have a cross section defined by three lines, the first line registering with a contour of the rotor at a minimum volume of the working space, the second line registering with the rotor contour at a maximum space volume, and the third line registering with the rotor contour at an intermediate space volume. Also it is possible to provide cooling ports 34 on the casing 1 (FIG. 9).

The shape of the rotor side faces (conical surfaces) and the shape of the casing plate face are decided by the value of the angle $\theta$, which is subtended by the transmission shaft and rotor spin shaft, and the value of the generating angle R. $\theta$ and R can be combined in various ways. Specifically, the size of $\theta$ is related to the stroke displacement and torque. In a typical case where the gear is arranged in the interior of the rotor, e.g. where the value of R is 90°, the value of $\theta$ can be as high as 18°. However, the upper limit is a very large value considering $\theta$ alone.

OPERATION

In the working chamber of the conventional rotary engine, the surface of the rotor casing defining a peritrochoidal curved surface and of the rotor defining the inner envelope surface form a working chamber the width whereof is perpendicular to a plane containing the peritrochoid. In the above embodiment of the invention, the casing plate 3 defining a spherical peritrochoid curved surface is arranged to have rotational symmetry with respect to the transmission shaft 4. Further, the locus or orbit of the rotor apex 25 defines a plane the same as that of the casing plate 3. Accordingly, the relationship between the conical surface 24 of the rotor and the casing plate 3 can be compared to the relationship between the two-dimensional rotary engine rotor and rotor casing of the prior art. Therefore, the volume of the working chamber in the embodiment of the invention changes in the manner shown from (I) to (IV) in FIG. 4 as the rotor precesses.

When a rotating force is applied to the transmission shaft 4, the rotor 2 is planetarily rotated via the precession journal by the internal gear 15 formed in the rotor and the external gear 14 secured to the casing. The rotor 2 spins while the center position is maintained via the small sphere 9 for supporting/bearing, and the rotor rounds about the support shaft 33 while the inclination of the spin shaft is maintained. The rotation of the rotor causes a volumetric change, as shown (I) through (IV) of FIG. 4, so that a fluid is drawn in from the inlets 20, 20' and exhausted from the outlets 21, 21'. (As to the inlets and outlets see FIG. 4(I).)

The compression (or exhaust) stroke in the working chamber is as shown in (I) through (IV) of FIG. 4 for a single working chamber. The stroke is the same in each of the working chambers. If the order of (I) through (IV) is reversed, this will represent an expansion stroke. The above stroke can be used in a compression or expansion engine (pump, etc.).

In the case of an internal combustion engine, one cycle is composed of a series of compression, expansion, exhaust (second compression) and intake (second expansion) strokes. Both the exhaust and intake strokes and the compression and expansion strokes are repeated by opening and closing the corresponding ports (serving as valves). As to the disposition and structure of the ports and ignition devices, ones similar to those in the Wankel rotary engine may be applied with appropriate adaptation and are not described here in detail.

Described above is a basic system comprising the conical surface of a rotor and the casing curved surface (casing plate surface) corresponding to the apex locus. However, the invention is not limited to this basic system but can be modified and expanded upon in many ways. Such modifications will now be described.

The casing plate can be rotated at a leaning angle $\theta$, so that the rotor in the first embodiment can be rotated at a stationary position (shaft position fixed). In this modification, although, the shape of the casing plate differs from the above-described peritrochoidal curve, relative precession is produced between the rotor and corresponding casing surface.

Figure 10:
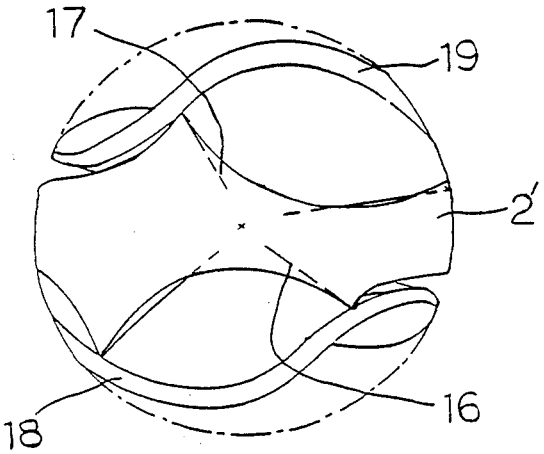
FIG. 10. is a partial elevational respective view of another embodiment of the invention.

Next, conical surfaces can be formed on both sides of the spherical precessing rotor, and the casing curved surfaces corresponding to the apex loci can have two faces formed internally of the spherical space. This example is shown in FIG. 10, in which the mechanism comprises apices 16, 17 and casing plates 18, 19 having corresponding casing curved surfaces. In this case, the relative precession of the rotors and casing surfaces generally takes place with the casing plates 18, 19 fixed. Rotational motion is possible in this case also even if the converse arrangement is adopted, i.e. by rotating a spherical rotor 2' at a stationary position and rotating the casing plates 18, 19 at the leaning angle. In FIG. 10, the apex angle positions of the upper and lower portions may avoid coincidence at the tip dead center, and the positions can be offset in order to obtain smooth movement.

Furthermore, the apex need not necessarily be formed linearly with the center of the rotor sphere serving as the top portion, and it will suffice if the inward end of the apex is extended toward the rotor spin shaft (the shaft of the rotor in a case where the rotor does not rotate, or particularly the sphere center).

In another modification, the two rotors of FIGS. 7 or 8 are arranged to flank the casing plate 3 from above and below so as to sandwich the casing plate, and the two mechanisms are combined by utilizing both surfaces of the casing plate. This not only conserves space but also enables the upper and lower rotors to be connected by connection means (e.g., spherical core). Though symmetry is not required in this case, it is necessary that the angle R be made smaller than 90° in order to achieve symmetry. This arrangement having the pair of upper and lower rotors is highly desirable in terms of the rotational balance of the rotary mechanism.

In a further modification, two rotors are combined by bringing their mutual conical surfaces into opposition. More specifically, the casing plate of the first embodiment is also formed as a rotor (referred to as "plate rotor"), this is combined at an incline with the first rotor, and the two rotors are rotated in mutual fashion. Instead of rotating the Z' shaft, the plate rotor is rotated to attain the same goal.

Though the rotor transmission mechanism hereinabove mentioned serves as the means for transmitting rotor rotation to the outside (principal shaft), a functional element of this kind is referred to generally as a precession journal (or tilt axes journal). Specifically, this is referred to as a mechanism in which a shaft inclined with respect to the principal shaft is rotatively connected with respect to the principal shaft.

Further, the seal between the inner peripheral surface of the casing defining the spherical surface and the rotor can be readily achieved by using a piston ring having a wavy shape curved along the sphere. Embodiments for the sealing are shown in FIG. 24.

The rotary mechanism of the present invention can be utilized as a rotary engine if the outlet 21' is used as an exhaust port and the inlet 20 is employed as an intake port, and if spark is provided at a suitable position. The intake and exhaust ports open and close automatically in accordance with rotation of the rotor. Synchronous open/close valves can also be provided as auxiliary equipment. In FIG. 4, a 4 cycle engine can be established by providing only a pair of inlet and outlet ports at an upper half or lower half of the equidistant projection. In FIG. 4(II) a spark plug is indicated by a symbol SP for the case where the ports (inlet 20, outlet 21') are provided only at the lower half area.

Figure 15:
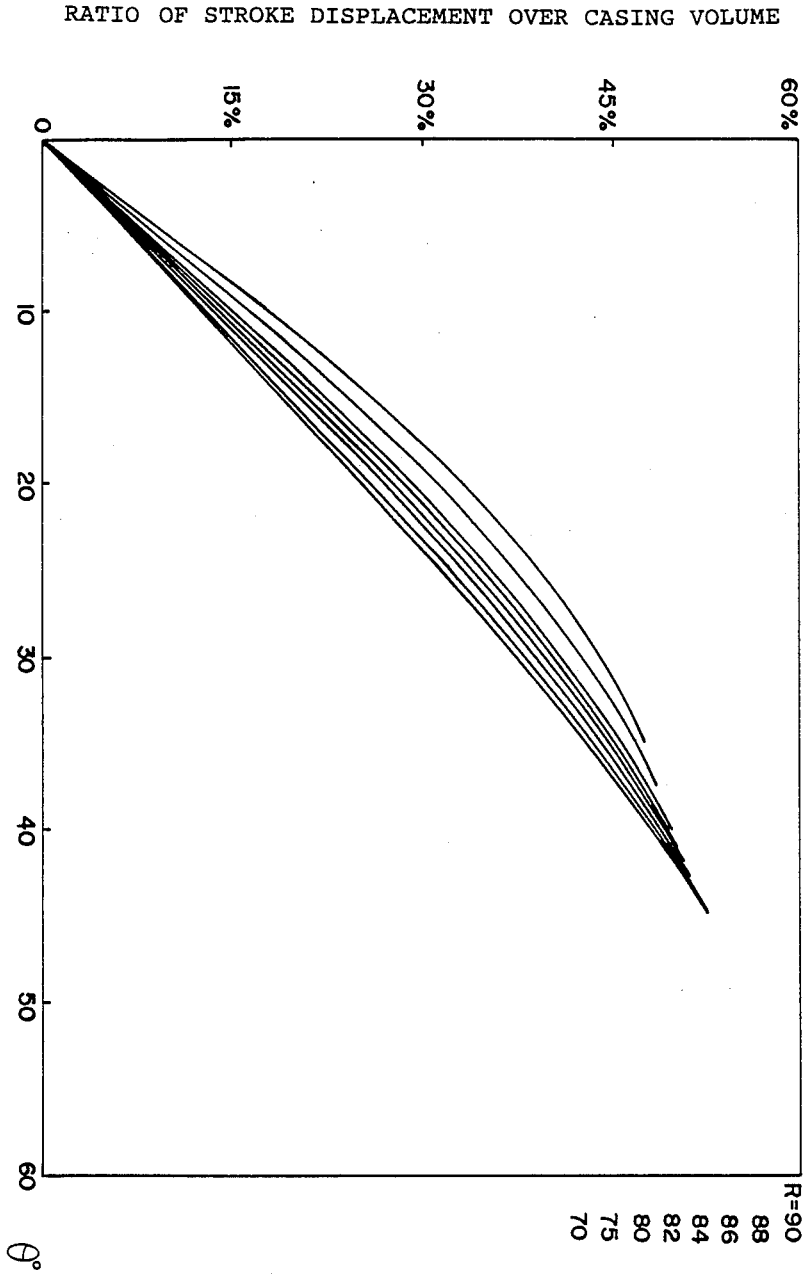
FIG. 15 is a graph showing the relationship between $\theta$, R and the stroke displacement volume.

FIG. 15 represents a graph showing the ratio of the stroke replacement over the total internal volume of the casing as a function of the leaning angle $\theta$ for different generating angles R=70–90 degrees in the case where n=3.

FIGS. 16–20 represent various embodiments of the transmission mechanism and the relative precession wherein Z represents a stationary axis while Z' a precessing axis. The term "rotor" for FIGS 16–20 denotes a member having apexes.

Figure 16:
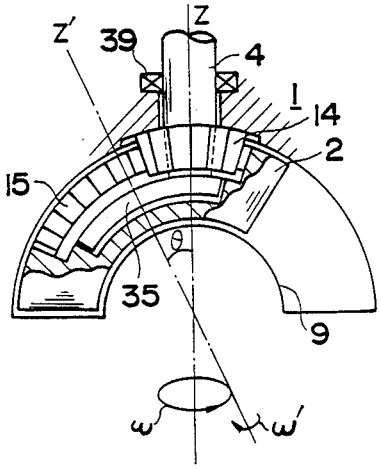
FIGS. 16–20 are sectional views illustrating different embodiments of the present invention.

FIG. 16 shows an embodiment wherein the internal gear 15 is provided on the rotor 2, and the external gear 14 is secured on a stationary casing 1. A disk type precession journal 35 is provided between the stationary rotating shaft 4 and the rotor 2. The shaft 4 is supported on the casing 1 by a bearing 39.

Figure 17:
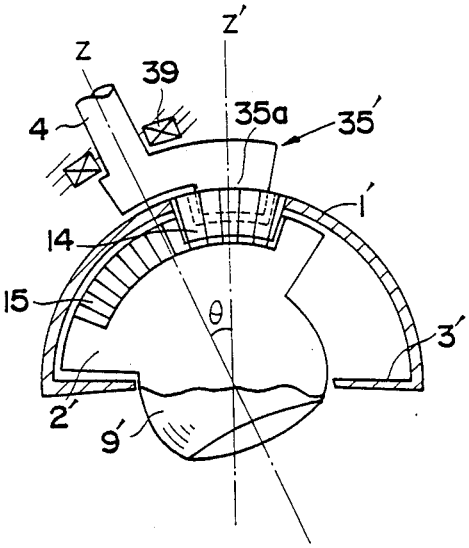

FIG. 17 shows an embodiment wherein the relative precession relationship is converse to FIG. 16. The internal gear 15 is provided on a rotor 2', and the external gear 14 is provided on a planetarily rotatable casing 1' formed integral with a casing plate 3'. A spherical core 9' is formed integral with the rotor 2'. A precession journal 35' with its arm **35*a* engaging with the center of the external gear 14 is rotatably supported on a stationary body (not shown) via a bearing about a stationary rotatable axis Z. The rotation torque may be transmitted from the rotor 2' via the spherical core 9'**.

Figure 18:
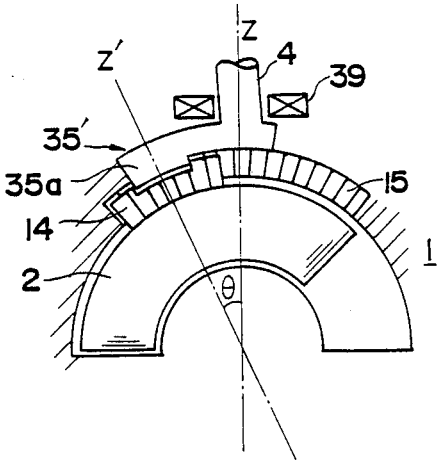

FIG. 18 shows an embodiment wherein the internal gear 15 is provided on the casing 1 while the external gear 14 is provided on the rotor 2. A precession journal 35' with its arm **35*a* engaging with the center (Z') of the external gear 14 is provided at the end of the stationary rotating shaft 4**.

As to FIG. 18, it is evident that the relative rotation between the rotor 2 and the casing 1 may be reversed, namely, the axis Z' may rotate at a stationary position while the axis Z may effect planetary rotation. In this case the axis Z' is supported rotatably at a stationary position through a fixed body (not shown), and the casing 1 is planetarily rotatably arranged.

Figure 19:
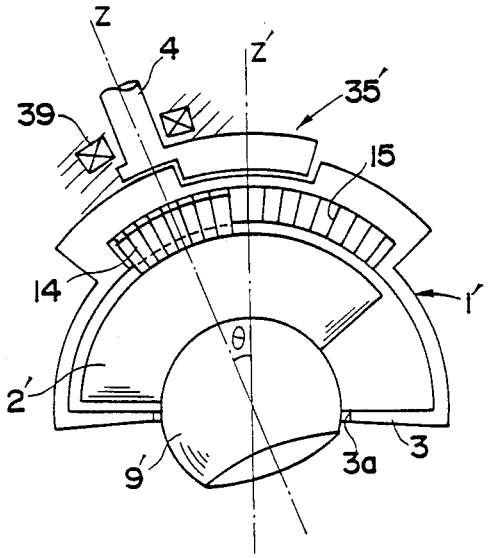

FIG. 19 shown a further embodiment wherein the external gear 14 is provided on a fixed (or stationarily rotatable) rotor 2' and the internal gear 15 is provided on a casing 1'. The casing 1' precesses with its axis Z' about the stationary axis Z. The rotation torque may be transmitted via the shaft 4. Sealing may be provided between the inner periphery **3*a* of the casing plate 3 and the spherical core 9'**.

Figure 20:
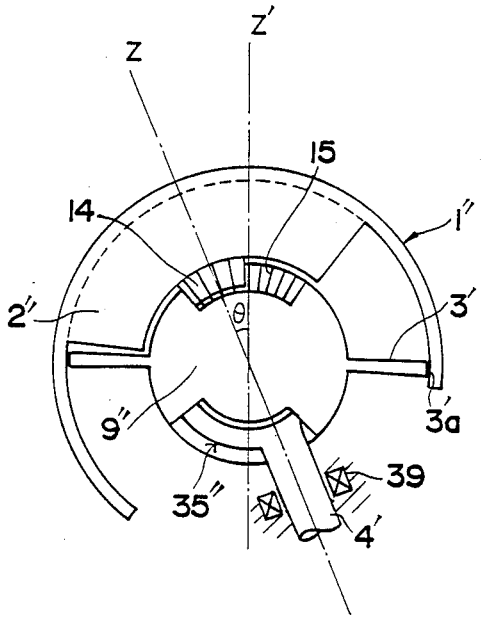

FIG. 20 shows a still further embodiment wherein a casing plate 3' is integrally formed with a spherical core 9'' having an internal gear 15 thereon meshing with an external gear 14 provided on the inner surface of the rotor 2'' integral with a spherical casing 1''. The spherical casing 1'' slidably contacts with the outer periphery **3*a*' of the casing plate 3'. A precession journal 35'' is provided on the end of a shaft 4' rotatably supported by a bearing 39 retained by a stationary body. This embodiment has the same relative precession relationship with FIG. 17 so far as the relationship between the rotor and the casing plate 3' is concerned. Sealing may be provided between the outer periphery 3' of the casing plate 3' and the spherical casing 1''**.

As previously mentioned, n may be 2, 3, 4 or more. In the foregoing embodiments n was 3. In the following, cases where n=2 and 4 will be described.

Figure 21:
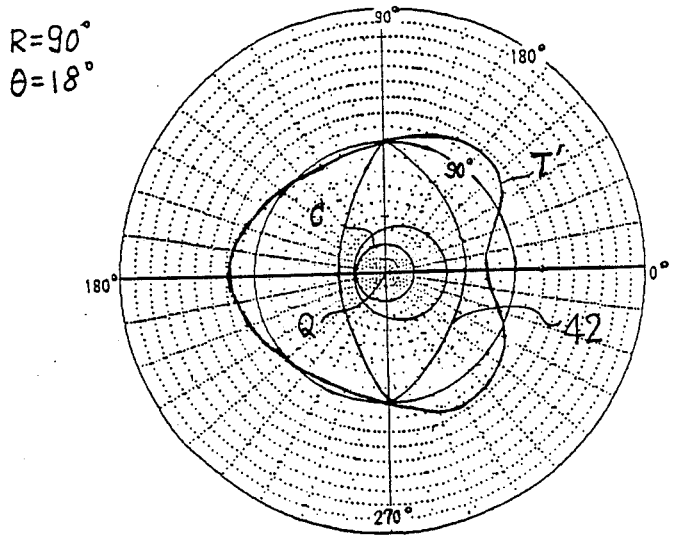
Figure 22:
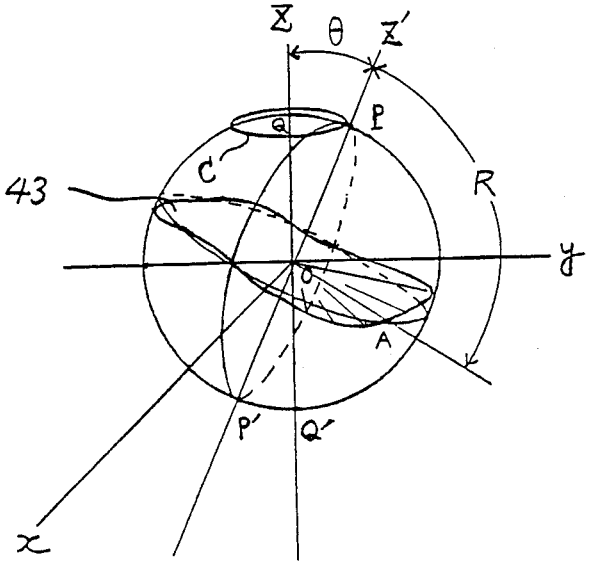

FIG. 21 shows an embodiment of n=2 by way of equidistant projection. T' represents a spherical peritrochoidal curve with one node, and 42 represents a corresponding rotor in the case where $\theta=18°$ and R=90°. FIG. 22 shows a casing plate 43 in a perspective view.

Figure 23:
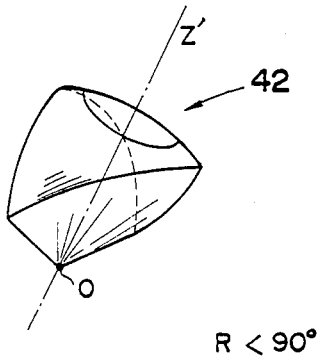
FIGS. 21–24 and 25–27 are views illustrating further embodiments of the present invention (n=2, 4).

In this embodiment, the leaning angle $\theta$ may assume up to about 20°, and the ration of the stroke displacement over the entire casing volume may achieve at most about 45%. With respect to the relative relationship for precession between two members, that for n=3 may be applied similarly. If R is less than 90° the rotor assumes a visually conical shape (FIG. 23). FIG. 24 shows another embodiment of a rotor with seal means, i.e., apex seals 23 and spherical (side) seals 46, or, optionally, a ring seal 47 extending around the internal gear 15. Spherical seals 45 extending from the central region of the spherical surface toward the outer end of the apex may be employed. Different arrangements of the seals may be employed upon request, e.g., seals 45 radially extending on the spherical surface from the ring seal 47 to the peripheral end of the apexes, etc.

Figure 25:
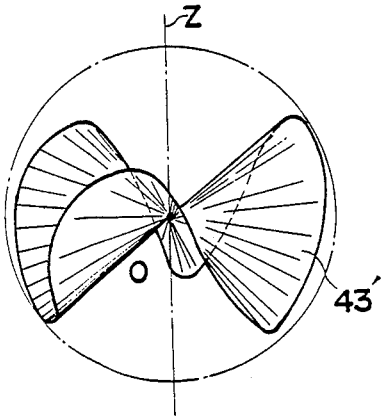
Figure 26:
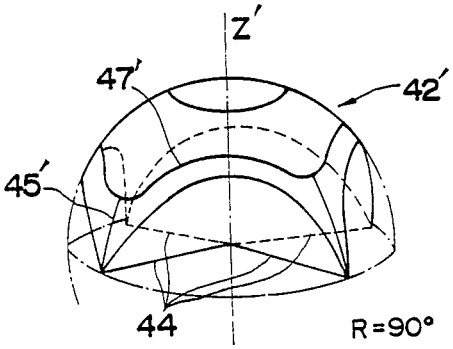
Figure 27:
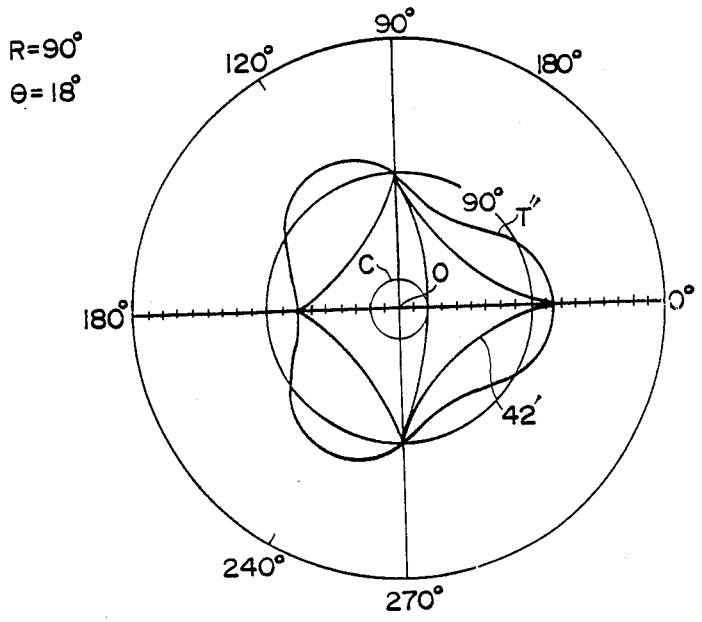

FIGS. 25 and 26 show embodiments for n=4. FIG. 25 shows an embodiment of a casing plate 43' with a 3-lobe spherical peritrochoid in the case with a large leaning angle $\theta$ and R=90°. FIG. 26 shows a corresponding embodiment of rotor 42' with four apexes 44. The relative precession relationship between the rotor and the casing (or casing plate) may be applied similarly to the case with n=3. A wave-like seal ring 47' is biasedly retained on the spherical surface of the rotor 42' so as to urge a radially expanding force. Radially extending spherical seals 45' extend from the seal ring 47' to the outer ends of apexes. FIG. 27 illustrates a 3-lobe spherical peritrochoid T'' at R=90° and $\theta$=18° and a corresponding rotor 42' by the equidistant projection. Further applications with n=5 or more are possible although not illustrated by reference to the Drawings.

In the foregoing, the term "rotor" is employed for the member designated by "2" "2'" etc., which may be called "piston", however, should not be interpreted merely as a rotating member. Essential is the relative precession motion between the rotor 2 and the member having a curved surface 3 (typically, casing plate).

As apparent in the disclosure, there is provided also a method for designing a spherical rotary mechanism characterized by establishing a spherical peritrochoid theoretically through calculation based on the equations defining the spherical peritrochoid. The three dimensional (or spherical) precessing motion can be visually represented on a planar graph by equidistant projection of a locus of a precession motion of a body, line, or point.

In contrast to the Wankel engine wherein the sliding stroke length or speed is largest at the apex seal, the sliding speed of the seals are far reduced in the present invention. Further, the sealing between the spherical surfaces (rotor and casing) is simplified by using a spherical seal of the piston-ring type which can provide high sealing performance and wear resistance, and low friction.

The provision of the spherical core provides further advantage that this enables connection of two rotors (1st and 2nd) disposed on the opposing surfaces of the casing plate in one spherical casing, provided that the spherical core is slidably arranged with respect to the casing plate. This embodiment can eliminate a planetary gear train otherwise to be assigned to the second rotor. Space economy is also excellent, and smooth rotation is expected due to concurrent rotation of opposing two rotors with good balance. By providing a precession phase difference to avoid simultaneous occurrence of top dead centers the smoothness of rotation will be further increased. In a four cycle engine, a combination of expansion stroke at the 1st rotor and compression stroke at the 2nd rotor is also possible.

In the present disclosure the stroke displacement volume $V_s$ is defined by $V_s = V_{max} - V_{min}$ where $V_{max}$ and $V_{min}$ are the maximum and minimum volume of a working space (chamber), respectively.

The leaning angle $\theta$ between the two axes and the generating angle R define the shape of the casing plate and rotor. The magnitude of $\theta$ and R also define the stroke displacement volume and the torque. In the case where the planetary gear train is disposed in the rotor, $\theta$ may be up to about 18° when R is set at about 90°, while a larger $\theta$ is permissible in the other embodiments. The leaning angle $\theta$ primarily affects the torque, and the generating angle R relates to the volume of the spherical space obtainable in the casing.

As previously mentioned, there is remarkable corresponding relationship between the present invention and the Wankel type machine. Conceptionally, Wankel's generating radius "R" of the trochoidal curve on the 2-dimensional plane corresponds to the generating angle R in the 3-dimensional, spherical coordinate system, Wankel's eccentric radius "e" corresponds to the leaning (eccentric) angle "$\theta$" (or the arc segment $\widehat{QP}$ on the sphere). Namely, the segmental factor of the trochoidal curve in the 2-dimensional coordinates correspond to the angular factor subtended by an arc in the spherical polar coordinates. The Wankel type machine produces the working space by giving thickness to the 2-dimensional surface area, whereas the spherical machine produces the working space by adding a radius to the spherical surface.

It can be more simply expressed by using vectors based on Eulerian angles. Eulerian angles comprise a precessional angle $\theta$, a nutational angle $\frac{1}{3}$, and a spin angle . They are equivalent to the leaning angle $\theta$, a planetary rotation angle $\omega t$, and a spin angle $-\frac{2}{3}\omega t$ of the spherical trochoidal curve, respectively. For convenience sake, if we use a unit sphere and the circular measure, they are equivalent to their corresponding a segment of an arc of the great circle.

Figure 14:
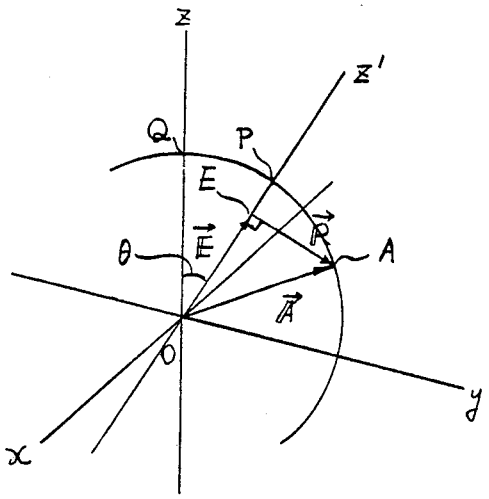
FIG. 14 is a view showing a vector representation of a spherical surface.

Using vector, locus of a generating point A of precessional rotor is expressed as follows for n=3. Analogously to the Wankel type, the radial vector $\vec{A}$ is an addition of an eccentric vector $\vec{E}$ and a generating vector $\vec{R}$ (see FIG. 14). Mathematical representation is as follows:

$$\vec{A} = \vec{E} + \vec{R}$$

A center of the sphere is equivalent to the origin of (x, y, z) coordinates. In this case, the eccentric vector $\vec{E}$ is $\vec{E}$ ($\epsilon \cos \omega t$, $\epsilon \sin \omega t$, $\cos \theta \cos R$) and the generating vector $\vec{R}$ is $\vec{R}$ $\{\rho C(\omega t/3), \rho S(\omega t/3), -\sin\theta\rho \cos \frac{2}{3}\omega t\}$ where replace $\rho = \sin R$, $\epsilon = \sin\theta \cos R$, $$C(\tfrac{1}{3}\omega t) = \cos\theta \cos\omega t \cos\tfrac{2}{3}\omega t + \sin\omega t \sin\tfrac{2}{3}\omega t$$

$$S(\tfrac{1}{3}\omega t) = \cos\theta \sin\omega t \cos\tfrac{2}{3}\omega t - \cos\omega t \sin\tfrac{2}{3}\omega t$$

provided that $\theta$, R and $\omega t$ are those previously mentioned. These functions of C, S are Eulerian transformations. To find the general relationship, replace the spin angle $\frac{2}{3}\omega t$ by (n—1)/n t.

E is a point which is dropped perpendicularly from point A toward a spin axis Z', and is not on the sphere. In this manner, swing angle of apexes, fundamental dimensions etc. of the inventive mechanism can be obtained likewise based on said parameter $\phi$.

The inventive mechanism can be used generally as a energy conversion machine, fluid/mechanical force or fluid/fluid. The working space may serve as expansion or compression chamber, or a combination thereof. By adjusting arrangement of ports, it can be used as an engine, particularly, an internal combustion engine. Diverse design possibility is achieved by selecting the "n" number, leaning angle $\theta$, generating angle R, port arrangement etc.

Accordingly, in the all, the present invention will provide a vast field of industrial application based on the fundamental concept and embodiments herein disclosed.

It should be understood that modifications from the disclosed embodiments may be made within the general concept of the present invention herein disclosed without departing from the claimed scope.

What is claimed is:

1. A rotary mechanism for a three-dimensional volumetric change, comprising:

a casing having an at least partly spherical inner space;

a rotor disposed in the casing and having a partially spherical surface associated with a spherical wall of said inner space as a bottom surface and a substantially conical surface which includes a plurality of apexes extending substantially radially;

a member having a curved surface constituted by a spherical peritrochoidal cone surface defined by a locus of the apex due to precessing motion of said rotor relative to the member; and a means for establishing the relative precessing motion at a defined angular velocity ratio;

wherein a space defined in the spherical space of the casing and having its volume changed by relative precessing motion between said member and said rotor serves as a working space; the relative precessing motion between said member and rotor has an angular velocity ratio of $\omega:\omega'=1:(1-1/n)$ where $\omega$ represents a planetary rotation velocity of a spin axis of one of said member and rotor, $\omega'$ represents a spin velocity of the spin axis per se, and n is a natural number of 2 or more and equal to the number of apexes in the rotor; and the casing includes at least one pair of inlet and outlet ports in the spherical wall.

2. The rotary mechanism as defined in claim 1, wherein said substantially conical surface of the rotor extends within and along, an inner envelope, produced by the relative precessing motion, of the spherical peritrochoidal cone surface of said member.

3. The rotary mechanism as defined in claim 2, wherein said substantially conical surface of the rotor has a configuration corresponding to said inner envelope of the spherical peritrochoidal cone surface.

4. The rotary mechanism as defined in claim 2, wherein said substantially conical surface of the rotor includes a plurality of conical surface areas defined between a pair of neighbouring apexes.

5. The rotary mechanism as defined in claim 1, wherein said substantially conical surface of the rotor has a vertex or imaginal vertex of cone which commensurates with the center of the spherical space.

6. The rotary mechanism as defined in claim 5, wherein said apexes extend substantially radially from the vertex of cone.

7. The rotary mechanism as defined in claim 1, wherein said apexes extend substantially radially from the axis of the rotor.

8. The rotary mechanism as defined in claim 1, wherein there is provided a spherical core between the rotor and said member cocentrical with the spherical space, and said rotor is frustum of spherical cone associated with the spherical core.

9. The rotary mechanism as defined in claim 4, wherein said member is formed as a casing plate.

10. The rotary mechanism as defined in claim 8, which further comprises a precession journal for transmitting precessing rotation of the rotor to a shaft rotatable about a stationary axis.

11. The rotary mechanism as defined in claim 1, wherein said means for establishing the relative precessing motion includes a planetary gear train.

12. The rotary mechanism as defined in claim 1, wherein the rotor precesses about a stationary axis of said member having a curved surface.

13. The rotary mechanism as defined in claim 1, wherein said member having a curved surface performs precessing motion relative to a fixed or revolving rotor at or about a stationary axis.

14. The rotary mechanism as defined in claim 1 wherein said member having a curved surface is formed integral with a casing.

15. The rotary mechanism as defined in claim 1, wherein said member having a curved surface is rotatable relative to the casing.

16. The rotary mechanism as defined in claim 1, which comprises a further curved surface on the opposite side of said member and a further rotor associated with said further curved surface.

17. The rotary mechanism as defined in claim 16, which further comprises a spherical core between said two rotors at the center of the spherical space penetrating the curved surfaces.

18. The rotary mechanism as defined in claim 17, wherein said spherical core connects said two rotors.

19. The rotary mechanism as defined in claim 18, wherein said two rotors have one of a different and the same rotation phase.

20. The rotary mechanism as defined in claim 1, wherein said rotor further includes another substantially conical surface on an opposite side to said substantially conical surface to provide a pair thereof.

21. The rotary mechanism as defined in claim 20, wherein said pair of substantially conical surfaces have one of an angular phase difference and the same angular phase.

22. The rotary mechanism as defined in claim 20, wherein a spherical core is further provided between and extending beyond said two substantially conical surfaces at the center of the spherical space.

23. The rotary mechanism as defined in claim 22, wherein said two substantially conical surfaces are connected through said spherical core.

24. The rotary mechanism as defined in claim 10, wherein said precession journal includes a spherical spline meshing the rotor with the core which is rotatable relative to the curved surface member, the core being connected to a shaft rotatable about a stationary axis.

25. The rotary as mechanism as defined in claim 11, wherein said planetary gear train includes a pair of internal ring and external bevel gears.

26. The rotary mechanism as defined in claim 25, wherein the external gear is stationary or provided on a casing, and the internal ring gear is provided on the rotor.

27. The rotary mechanism as defined in claim 25, wherein the internal gear is stationary or provided on a casing, and the external gear is provided on the rotor.

28. The rotary mechanism as defined in claim 25, wherein the external gear is provided on the rotor and the internal gear is provided on a spherical core formed integral with the member having a curved surface.

29. The rotary mechanism as defined in claim 1, wherein n is 2, 3 or 4.

30. The rotary mechanism as defined in claim 8, wherein said spherical core is formed integral with the rotor.

31. The rotary mechanism as defined in claim 8, wherein said spherical core is formed integral with said member having a curved surface.

32. The rotary mechanism as defined in claim 8, wherein said spherical core is rotatable relative to the rotor and the member having a curved surface.

33. The rotary mechanism as defined in claim 1, which further comprises a precession journal comprising:

a shaft rotatable about a stationary axis, and a disk or arm provided on one end of the shaft and eccentrically extending from the shaft, the disk or arm having engaging means for engaging with a rotary body of the rotor and said member at a center axis of said rotary body, the center axis of the rotary body intersecting the axis of said shaft at an angle.

34. The rotary mechanism as defined in claim 33, wherein said engaging means includes a disk, the axis of which passes the center of the spherical space, and the periphery of which rotatably engages with the rotary body.

35. The rotary mechanism as defined in claim 33, wherein said engaging means includes a pivot engaging with the rotary body, the axis of the pivot passing the center of the spherical space and the rotary body.

36. The rotary mechanism as defined in claim 17, wherein a precession journal is provided in the spherical core.

37. The rotary mechanism as defined in claim 17, wherein an eccentric planetary gear train is provided between said spherical core and the rotor.

38. The rotary mechanism as defined in claim 1, wherein said port has a cross section defined by three lines, the first line registering with a contour of the rotor at a minimum volume of the working space, the second line registering with the rotor contour at a maximum space volume, and the third line registering with the rotor contour at an intermediate space volume.

39. The rotary mechanism as defined in claim 38, wherein at least two ports are disposed at neighbouring phases of rotation.

40. The rotary mechanism as defined in claim 39, wherein $n=3$ and one port is disposed at each quadrant.

41. The rotary mechanism as defined in claim 1, which further includes sealing means between sliding contact surfaces.

42. The rotary mechanism as defined in claim 41, wherein said sealing means includes at least one of an apex seal and a spherical seal.

43. The rotary mechanism as defined in claim 1, which is at least one of an expansion machine and a compression machine.

44. The rotary mechanism as defined in claim 1, which is one of a pump and a blower.

45. The rotary mechanism as defined in claim 1, which is an internal combustion engine.

46. A rotary mechanism for a three-dimensional volumetric change, comprising:

a casing having an at least partly spherical inner space;

a rotor disposed in the casing and having a partially spherical surface associated with a spherical wall of said inner space as a bottom surface and a substantially conical surface which includes a pair of apexes extending substantially radially;

a member having a curved surface constituted by a spherical peritrochoidal cone surface defined by a locus of the apex due to precessing motion of said rotor relative to the member; and a means for establishing the relative precessing motion at a defined angular velocity ratio;

wherein a space defined in the spherical space of the casing and having its volume changed by relative precessing motion between said member and said rotor serves as a working space, and the relative precessing motion between said member and rotor has an angular velocity ratio of $\omega:\omega'=2:1$ wherein $\omega$ represents a planetary rotation velocity of a spin axis of one of said member and rotor, and $\omega'$ represents a spin velocity of the spin axis per se.

47. The rotary mechanism as defined in claim 46, wherein said substantially conical surface of the rotor extends within and along an inner envelope produced by the relative precessing motion of the spherical peritrochoidal cone surface of said member.

48. The rotary mechanism as defined in claim 47, wherein said substantially conical surface of the rotor has a configuration corresponding to said inner envelope of the spherical peritrochoidal cone surface.

49. The rotary mechanism as defined in claim 47. wherein said substantially conical surface of the rotor includes a pair of conical surface areas defined between said pair of apexes.

50. The rotary mechanism as defined in claim 46, wherein said substantially conical surface of the rotor has a cone vertex which commensurates with the center of the spherical space.

51. The rotary mechanism as defined in claim 50, wherein said apexes extend substantially radially from the cone vertex.

52. The rotary mechanism as defined in claim 46, wherein said apexes extend substantially radially from the axis of the rotor.

53. The rotary mechanism as defined in claim 46, wherein there is provided a spherical core between the rotor and said member cocentrical with the spherical space, and said rotor is a spherical cone frustum associated with the spherical core.

54. The rotary mechanism as defined in claim 47, wherein said member is formed as a casing plate.

55. The rotary mechanism as defined in claim 46, which further comprises a precession journal for transmitting precessing rotation of the rotor to a stationary rotating axis.

56. The rotary mechanism as defined in claim 46, wherein said means for establishing the relative precessing motion includes a planetary gear train.

57. The rotary mechanism as defined in claim 46, wherein the rotor precesses about a stationary axis of said member having a curved surface.

58. The rotary mechanism as defined in claim 46, wherein said member having a curved surface performs precessing motion relative to one of (a) a fixed rotor, (b) a revolving rotor at a stationary axis, and (c) a revolving rotor about a stationary axis.

59. The rotary mechanism as defined in claim 46, wherein said member having a curved surface is formed integrally with a casing.

60. The rotary mechanism as defined in claim 46, wherein said member having a curved surface is rotatable relative to the casing.

61. The rotary mechanism as defined in claim 46, which further comprises a further curved surface on the opposite side of said member and a further rotor associated with said further curved surface.

62. The rotary mechanism as defined in claim 61, which further comprises a spherical core between said two rotors at the center of the spherical space penetrating the curved surfaces.

63. The rotary mechanism as defined in claim 62, wherein said spherical core connects said two rotors.

64. The rotary mechanism as defined in claim 63, wherein said two rotors have different rotation phases.

65. The rotary mechanism as defined in claim 63, wherein said two rotors have the same rotation phase.

66. The rotary mechanism as defined in claim 46, wherein said rotor further includes another substantially conical surface on an opposite side to said substantially conical surface to provide a pair thereof.

67. The rotary mechanism as defined in claim 66, wherein said pair of substantially conical surfaces have an angular phase difference.

68. The rotary mechanism as defined in claim 66, wherein said pair of substantially conical surfaces have the same angular phase.

69. The rotary mechanism as defined in claim 66, wherein a spherical core is further provided between and extending beyond said two substantially conical surfaces at the center of the spherical space.

70. The rotary mechanism as defined in claim 69, wherein said two substantially conical surfaces are connected through said spherical core.

71. The rotary mechanism as defined in claim 56, wherein said planetary gear train includes a pair of internal ring and external bevel gears.

72. The rotary mechanism as defined in claim 71, wherein the external gear is stationary or provided on a casing, and the internal inner gear is provided on the rotor.

73. The rotary mechanism as defined in claim 71, wherein the internal gear is stationary or provided on a casing, and the external gear is provided on the rotor.

74. The rotary mechanism as defined in claim 71, wherein the external gear is provided on the rotor and the internal gear is provided on a spherical core formed integrally with the member having a curved surface.

75. The rotary mechanism as defined in claim 53, wherein said spherical core is formed integrally with the rotor.

76. The rotary mechanism as defined in claim 53, wherein said spherical core is formed integrally with said member having a curved surface.

77. The rotary mechanism as defined in claim 53, wherein said spherical core is rotatable relative to the rotor and the member having a curved surface.

78. The rotary mechanism as defined in claim 46, which further comprises a precession journal comprising:

a shaft rotatable about a stationary axis, and one of a disk and arm provided on one end of the shaft and eccentrically extending from the shaft, the disk or arm having engaging means for engaging with a rotary body of the rotor and said member at a center axis of said rotary body, the center axis of the rotary body intersecting the axis of said shaft at an angle.

79. The rotary mechanism as defined in claim 78, wherein said engaging means includes a disk, the axis of which passes the center of the spherical space, and the periphery of which rotatably engages with the rotary body.

80. The rotary mechanism as defined in claim 78, wherein said engaging means includes a pivot engaging with the rotary body, the axis of the pivot passing the center of the spherical space and the rotary body.

81. The rotary mechanism as defined in claim 55, wherein said precession journal transmits the precessing rotation of the rotor including spin rotation thereof.

82. The rotary mechanism as defined in claim 62, wherein an eccentric planetary gear train is provided between said spherical core and the rotor.

83. The rotary mechanism as defined in claim 46, wherein the casing further has at least one pair of inlet and outlet ports on the spherical surface of the casing at neighboring phases of rotation.

84. The rotary mechanism as defined in claim 46, which further comprises sealing means between sliding contact surfaces.

85. The rotary mechanism as defined in claim 84, wherein said sealing means comprises at least one of an apex seal and a spherical seal.

86. The rotary mechanism as defined in claim 46, which is at least one of an expansion machine and a compression machine.

87. The rotary mechanism as defined in claim 46, which is one of a pump and a blower.

88. The rotary mechanism as defined in claim 46, which is an internal combustion engine.

89. A rotary mechanism for a three-dimensional volumetric change, comprising;

a casing having an at least partly spherical inner space and at least a pair of inlet and outlet ports in a spherical wall of the spherical space;

a rotor disposed in the casing and having a partially spherical surface as a bottom surface associated with a spherical wall of said inner space, and a substantially conical surface which includes a plurality of apexes extending substantially radially;

a member having a curved surface constituted by a spherical peritrochoidal cone surface defined by a locus of the apex due to precessing motion of said rotor relative to the member;

a spherical core disposed between the rotor and said member cocentrical with the spherical space, said rotor being a spherical cone frustum associated with the spherical core;

a shaft stationarily rotatable relative to the casing;

precession journal means for transmitting the rotation of the rotor including its spin rotation relative to the shaft; and a planetary gear train for establishing the relative precessing motion between said member and rotor at an angular velocity ratio of $\omega:\omega'=n:(n-1)$ where $\omega$ represents a planetary rotation velocity of a spin axis of one of said member and rotor, and $\omega'$ represents a spin velocity of the spin axis per se, and n is a natural number of 2 or more and equal to the number of apexes on the rotor;

wherein a space defined in the spherical space of the casing and having its volume changed by relative precessing motion between said member and said rotor serves as a working space.

90. The rotary mechanism as defined in claim 89, wherein said precession journal means comprises a spherical spline between the rotor and the spherical core, and the spherical core is connected to the shaft.

91. The rotary mechanism as defined in claim 90, wherein said spline is flat and allows tilting within a leaning angle $\theta$ between the rotor axis and the shaft.

92. The rotary mechanism as defined in claim 89, wherein said planetary gear train includes a pair of internal and external gears, the external gear being secured on the casing and the internal ring gear being on the rotor.

93. The rotary mechanism as defined in claim 92, wherein said shaft rotatably penetrates said external gear.

* * * * *